US006449886B1

(12) United States Patent
Gray

(10) Patent No.: US 6,449,886 B1
(45) Date of Patent: Sep. 17, 2002

(54) UNIVERSAL TRANSPARENT GREETING CARD AND MULTIPLE PURPOSE HOLDER

(75) Inventor: William (Bill) James Gray, Tulsa, OK (US)

(73) Assignee: William James Gray, Tulsa, OK (US)

( * ) Notice: Subject to any disclaimer, the term of this patent is extended or adjusted under 35 U.S.C. 154(b) by 53 days.

(21) Appl. No.: 09/900,157

(22) Filed: Jul. 9, 2001

Related U.S. Application Data

(60) Provisional application No. 60/219,258, filed on Jul. 18, 2000.

(51) Int. Cl.[7] ..... B42F 13/00

(52) U.S. Cl. ..... 40/124.01; 402/79; 281/21.1; 281/38

(58) Field of Search ..... 40/124.01; 402/79, 402/500; 281/21.1, 38

(56) References Cited

U.S. PATENT DOCUMENTS 5,683,194 A * 11/1997 Emmel et al. ..... 402/199
5,842,720 A * 12/1998 Ward ..... 402/79

* cited by examiner

*Primary Examiner*—Cassandra H. Davis
(74) *Attorney, Agent, or Firm*—Head Johnson & Rachigian

(57) ABSTRACT

A greeting card or document holder constructed from an elongated piece of plastic folded in half along its longitudinal axis, the two halves are then bonded together along a line running parallel with the fold. An adhesive is located inside the two flaps created by the fold adjacent to the longitudinal edges opposite the fold. The two adhesives are located such that they can attach to the front and back surface of a greeting card or other brochure.

6 Claims, 2 Drawing Sheets

UNIVERSAL TRANSPARENT GREETING CARD AND MULTIPLE PURPOSE HOLDER

This application claims priority from Provisional application Ser. No. 60/219,258, filed Jul. 18, 2000.

BACKGROUND OF INVENTION

My Universal Transparent Greeting Card and Multiple Purpose Holder Invention would fall under the classification of Greeting Card Holders and Document Holders.

All patent research to date exhibit complex pocket style card holder designs. Pocket style greeting card holders do not secure cards and require people to remove cards to read the inner contents of cards.

My Card Holder invention is the first card holder that solves all the mathematical variables required to hold and view greeting cards like photos in a photo album. My simplified one piece card holder design exhibits the needed lateral support, strength and durability to with stand continuous use in all types of Ring Binder designs and styles. It also allows support and hinging action to allow people to open and view inner contents of all Greeting Card styles and designs.

BRIEF SUMMARY OF THE INVENTION

This Greeting Card holder invention is the result of my long time desire and need to organize, compile and view my valued written expressions of love written in the greeting cards given to me by my daughter.

A timely chain of events allowed me to develop and overcome all the variables involved to create a holding device for any and all Greeting Card styles and designs. My invention has also discovered a long time needed consumer product. I have discovered that people saving Greeting Cards is the rule and not the exception.

I have also discovered that my Greeting Card holder has many other uses other than just holding Greeting Cards. This holding devise is universal because it can be used to put and hold any type flat object into any ring binder design.

My Universal Holder Device invention exhibits a one piece design to except all sizes and styles of Greeting Cards. This new holding device is constructed from a transparent strip of plastic. The plastic strip has three strips of double sided adhesive tape running the length of the plastic strip on the same side. The plastic strip becomes a holding devise when folded lengthwise and sealed in the middle. Holes are put in the middle to aid in support of the ring binder to be used.

The edge of the center adhesive strip on the card holding side serves two purposes. It serves as a straight rigid card alignment guide and a hinging axis to open and view inner contents of cards.

Figure 1:
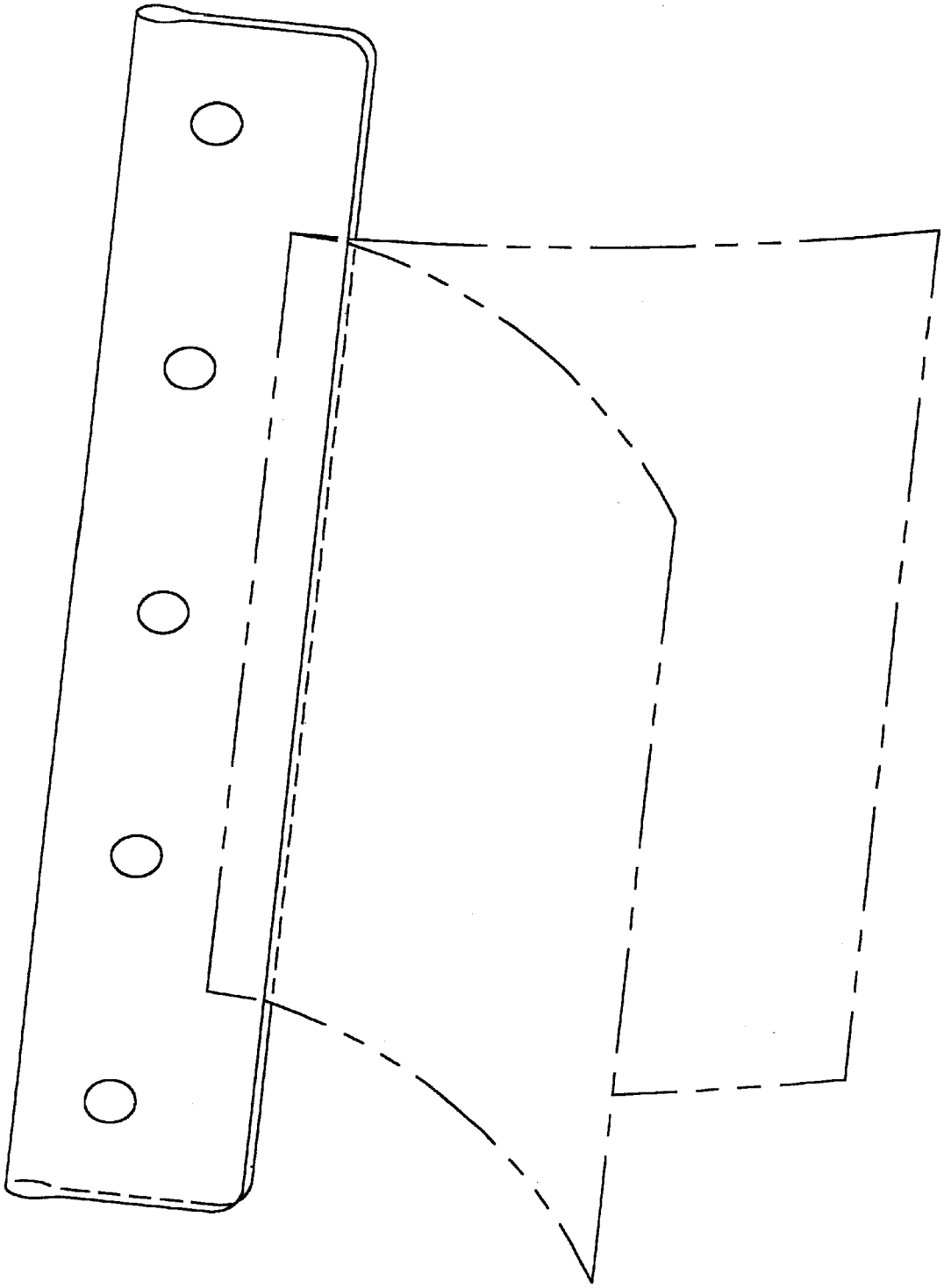
FIG. 1 illustrates the manor and fashion Greeting Cards and objects appear in my card holder in a final usable form. This drawing shows a Greeting Card attached to it. The adhesive strips are transparent like the holder itself. For this reason they cannot be seen in this drawing. The circles are holes to allow support when put into a clip ring style Binder.
Figure 2:
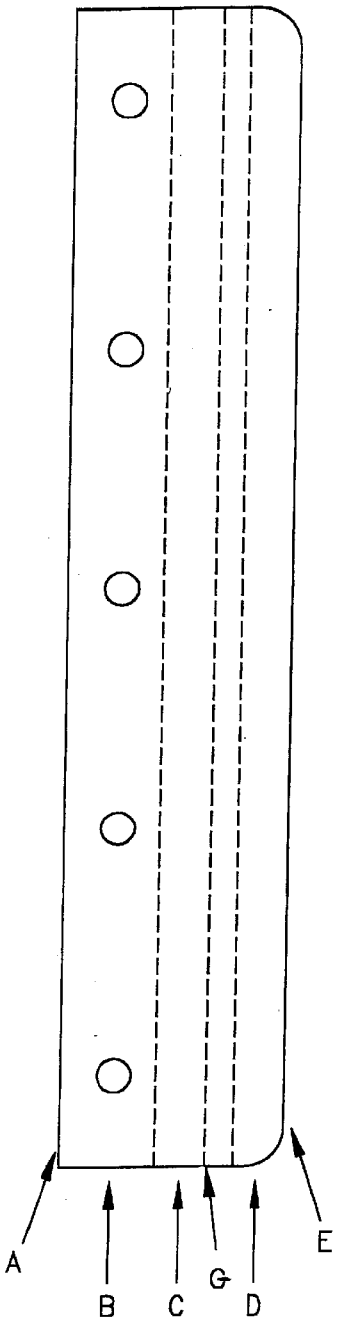
FIG. 2 illustrates a direct side view of my card holder invention in a vertical and folded position.
Figure 3:
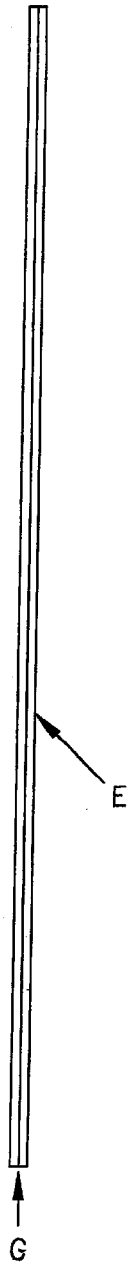
FIG. 3 illustrates the card holding side in a closed vertical position. These two pieces open up to secure the folded side of Greeting Cards.
Figure 4:
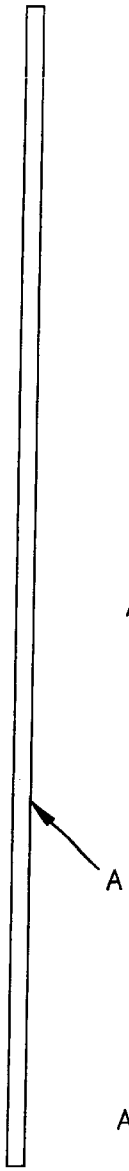
FIG. 4 illustrates the left binder holding side of my card holder invention in a vertical upright position. This is the folded side which creates the needed rigid lateral strength required to be secured in a metal clip ring style binder.
Figure 5:
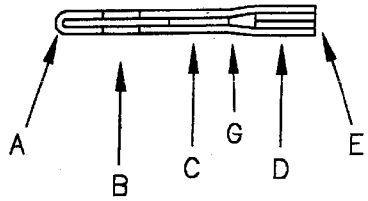
FIG. 5 illustrates the top and bottom view of my card holding invention in a horizontal closed position.
Figure 6:
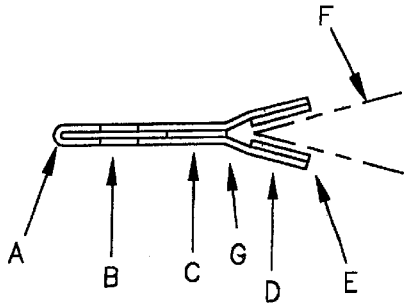
FIG. 6 illustrates a top and or bottom view of my card holder invention in a horizontal and folded position. This drawing also shows my card holder attached with the center adhesive strip. It also shows the card holding side of my holder open to illustrate where and how a greeting card is secured to the holder.
Figure 7:
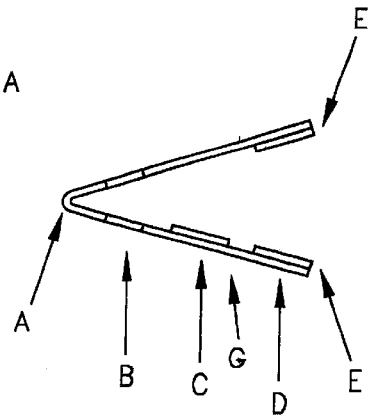
FIG. 7 illustrates the top and or bottom end view in a horizontal folded and open position.

DESCRIPTION AND EXPLANATION OF ALPHABETICAL CHARACTER REFERENCE ARROWS ON DRAWING PAGE 2

Reference arrow (A) represents the folded binder holding side of my card holder in a vertical position.

Reference arrow (B) represents the location where holes are punched out. The holes are to allow my holder to be secured to a clip ring style binder.

Reference arrow (C) represents the location where the adhesive strip secures and bonds the center of my card holder when folded in half. The right side of this bonded area creates the axis for the hinging action to allow Greeting Cards to be opened.

Reference arrow (D) represents the card holding side where adhesive strips are affixed along the inner open side. These adhesive strips run the length of my holder to secure greeting cards to my holder.

Reference arrow (E) represents the right open card holding side of my card holder invention.

Reference arrow (F) represents a folded Greeting Card and the manor and location it is attached to my card holding device invention.

Reference arrow (G) represents the rigid straight bonded location which serves as a card opening axis and an alignment guide to attach the cards folded edge.

DETAILED DESCRIPTION OF MY INVENTION

My simplified universal Greeting Card holder invention was designed with minimum manufacturing cost in mind. My card holding device can be completely made and assembled by machine. This method assures minimum cost with consistent precision quality workmanship.

The process to make and manufacture my card holding invention is a simple process.

First apply three narrow adhesive strips to the extruded plastic strip then punch ring binder support holes to fit binder to be used. The transparent adhesive strips run the length of the holder on the same side.

Second fold the plastic strips lengthwise in half down the center with the adhesive strips facing each other. This completes the manufacturing process.

My card holder invention is the first card holder to introduce a one piece simplified design.

My card holder invention is the first card holder to use adhesive strips to hold and secure Greeting cards.

My card holder device is the first to introduce the ability to open and read any and all Greeting Card styles without having to remove them from pockets.

My card holder invention is the first card holder designed with calibrated rigid vertical strength and calibrated lateral flexible support.

My card holder invention will enable people put any thin flat objects into clip ring binders. Putting cards and flat objects in clip ring style binders is a popular way to store an catalog things. It's one of the best known ways to store, compile, organize, things in an orderly manor for viewing.

When the vertical adhesive strip in the middle is attached the inside edge on the card holding side serves two purposes. One it serves as a solid straight alignment guide to secure the card against. And second it creates a strong straight hinging axis to allow people to open and read the inner contents of their cards.

What is claimed is:

1. A multipurpose holder comprising:

an elongated strip with a fold running along an elongated center axis, an inside and outside surface, and a first and second elongated lateral edge, the first and second lateral edges are disposed on either sides of the fold, a first flap is located between the fold and the first lateral edge, a second flap is located between the fold and the second lateral edge, a bond between the first and second flaps at points running along a line parallel with the fold, first adhesive is located adjacent to the first lateral edge on the inside surface, a second adhesive is located adjacent to the second lateral edge on the inside surface and, a plurality of apertures extend through the strip located between the fold and the first and second adhesives,

2. The multipurpose holder as claimed in claim 1, wherein the first and second adhesives have a removable protective covers.

3. The multipurpose holder as claimed in claim 1, wherein the first adhesive is a plurality of points along a line.

4. The multipurpose holder as claimed in claim 1, wherein the second adhesive is a plurality of points along a line.

5. The multipurpose holder as claimed in claim 1, wherein the bond is one continuous elongated bead.

6. The multipurpose holder as claimed in claim 1, wherein the strip is transparent.

* * * * *